US006280827B1

(12) United States Patent
Kume et al.

(10) Patent No.: US 6,280,827 B1
(45) **Date of Patent: *Aug. 28, 2001**

(54) SHEET FOR PRINTING, INK, AND PRINTED SHEET

(75) Inventors: Katsuya Kume; Katsuyuki Okazaki, both of Osaka (JP)

(73) Assignee: Nitto Denko Corporation, Osaka (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/157,405

(22) Filed: Sep. 21, 1998

(30) Foreign Application Priority Data

Jun. 16, 1997 (JP) ..... 9-176460
Jan. 23, 1998 (JP) ..... 10-26414

(51) Int. Cl.[7] ..... B41M 5/00

(52) U.S. Cl. ..... 428/195; 428/421; 428/422; 428/354

(58) Field of Search ..... 428/195, 421, 428/422, 913, 914, 354

(56) References Cited

U.S. PATENT DOCUMENTS

| | | | | |
|---|---|---|---|---|
| 5,098,883 | * | 3/1992 | Aono | 503/227 |
| 5,203,941 | * | 4/1993 | Spain et al. | 156/209 |
| 5,242,887 | | 9/1993 | Usui | 503/227 |
| 5,376,433 | | 12/1994 | Fujimaki | 428/195 |
| 5,709,977 | * | 1/1998 | Malhotra | 430/124 |
| 5,741,583 | | 4/1998 | Yoshida | 428/327 |
| 6,040,356 | * | 3/2000 | Kanki et al. | 523/160 |

FOREIGN PATENT DOCUMENTS

| | | |
|---|---|---|
| 63043980 | 2/1988 | (EP) . |
| 0 368 320 | 11/1989 | (EP) . |
| 02004592 | 1/1990 | (EP) . |
| 0 429 666 A1 | 6/1990 | (EP) . |
| 0 583 940 A2 | 8/1993 | (EP) . |
| 06127160 | 5/1994 | (EP) . |
| 07566707 | 10/1995 | (EP) . |

OTHER PUBLICATIONS

European Search Report dated Jun. 15, 1999.

* cited by examiner

*Primary Examiner*—Bruce H. Hess
(74) *Attorney, Agent, or Firm*—McGuireWoods, LLP

(57) ABSTRACT

A sheet for printing, which comprises an ink-receiving layer comprising a fluoropolymer film, optionally having property to absorb or scatter ultraviolet rays; an ink comprising a fluoropolymer and a colorant; and a printed sheet comprising the sheet for printing and information comprising the ink formed on the ink-receiving layer of the sheet by thermal transfer printing. With the sheet for printing and the ink, it is possible to form a printed sheet having so high weatherability that the ink information, even upon outdoor weathering, does not disappear and retains satisfactory readability over long period of time without the necessity of forming a coating layer thereon, by imparting ink information in situ, etc. by thermal transfer printing according to circumstances. Ink information can be imparted according to circumstances even with a commercial thermal transfer printer, and the ink information formed is excellent in fixability and weatherability because the ink, during the thermal transfer, was satisfactorily fused and contact-bonded to the ink-receiving layer through the fluoropolymers.

7 Claims, 1 Drawing Sheet

SHEET FOR PRINTING, INK, AND PRINTED SHEET

FIELD OF THE INVENTION

The present invention relates to a sheet for printing and an ink, which can form a printed sheet having excellent weatherability by thermal transfer printing, and a printed sheet comprising those.

BACKGROUND OF THE INVENTION

Conventional identification labels usable for the management of, for example, products and parts both for long-term outdoor use include metallic nameplates bearing carved information and labels bearing ink information protected and covered with a weather-resistant plastic film. However, with shifting to a production system in which many kinds of products are produced in small quantities, it has become difficult to issue labels according to circumstances. There has hence been a problem that label issuance cannot cope with the production system in which many kinds of products are produced in small quantities.

On the other hand, still another kind of conventional label comprises a paper or plastic film bearing a wax- or resin-based ink deposited thereon according to circumstances by thermal transfer printing. However, this label has a problem that the ink information has so poor weatherability that it disappears upon long-term outdoor weathering and the label is thus deprived of its function.

SUMMARY OF THE INVENTION

The present invention has been made to develop a sheet for printing and an ink with both of which a printed sheet having so high weatherability that the ink information, even upon outdoor weathering, does not disappear and retains satisfactory readability over long period of time without the necessity of forming a coating layer thereon can be formed by imparting ink information in situ, etc. by thermal transfer printing according to circumstances.

Accordingly, one object of the present invention is to provide a sheet for printing.

Another object of the present invention is to provide an ink.

Still another object of the present invention is to provide a printed sheet using the sheet for printing and the ink.

The sheet for printing according to the present invention comprises an ink-receiving layer comprising a fluoropolymer film.

The ink according to the present invention comprises a fluoropolymer and a colorant.

The printed sheet according to the present invention comprises the sheet for printing and an information comprising the ink, formed on the ink-receiving layer of the sheet by thermal transfer printing.

According to the present invention, due to the combined use of an ink-receiving layer and an ink both comprising a fluoropolymer, it is possible to impart ink information according to circumstances even with a commercially available thermal transfer printer. The ink information formed is excellent in fixability and weatherability because the ink, during the thermal transfer, was satisfactorily fused and contact-bonded to the ink-receiving layer through the fluoropolymers. Hence the ink information does not disappear even when exposed outdoors without forming a coating layer thereon. Consequently, a printed sheet having long-lasting satisfactory readability can be issued at any time. In the case where either the ink-receiving layer or a reinforcement on which the layer is supported is made to have the property of absorbing or scattering ultraviolet rays, underlying layers such as a coloring layer and an adhesive layer can be protected against ultraviolet rays and thus prevented from deterioration, whereby a further improvement in weatherability can be attained.

BRIEF DESCRIPTION OF THE DRAWINGS

FIG. 2 is a sectional view of one embodiment of the sheet for printing, wherein:

1: Sheet for printing (ink-receiving layer)
- 11: Ink-receiving layer
- 12: Reinforcement

2: Ink information layer

3: Adhesive layer

4: Adherend

DETAILED DESCRIPTION OF THE INVENTION

The sheet for printing of the present invention has at least an ink-receiving layer comprising a fluoropolymer film.

The ink of the present invention comprises a fluoropolymer and a colorant as components thereof.

The printed sheet of the present invention comprises the sheet for printing and an information comprising the ink, formed on the ink-receiving layer of the sheet by thermal transfer printing.

Figure 1:
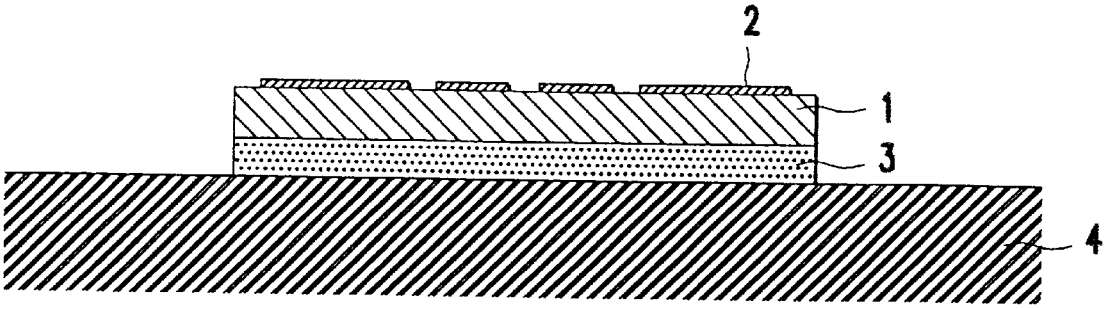
FIG. 1 is a sectional view of one embodiment of the printed sheet.

One example of the printed sheet is shown in FIG. 1, wherein 1 is a sheet for printing, 2 is an ink information layer, 3 is an adhesive layer which is optionally formed, and 4 is an adherend.

Figure 2:
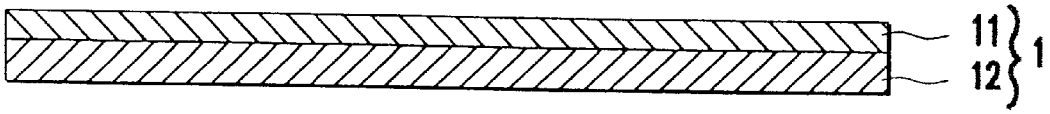

The sheet for printing may have any sheet structure so long as the ink-receiving layer comprising a fluoropolymer film is exposed on at least one side. Consequently, the sheet for printing can be formed in an appropriate constitution. Examples of the sheet include a sheet consisting of an ink-receiving layer 1 as shown in FIG. 1, that is, a single-layer constitution consisting of a fluoropolymer film; a composite constitution comprising an ink-receiving layer 11 and a reinforcement 12 as shown in FIG. 2; and a constitution additionally having an adhesive layer.

The composite constitution described above can be formed by an appropriate method such as a method in which an ink-receiving layer is formed on a sheet-form reinforcement by thermal laminating, extrusion coating, etc., a method in which a sheet-form reinforcement is impregnated or coated with a solution of a material for forming an ink-receiving layer or with a melt of the material, a method in which a sheet-form reinforcement is disposed within an ink-receiving layer, or a method in which a reinforcement in a fibrous or another form is incorporated into an ink-receiving layer.

Consequently, the reinforcements used above have appropriate properties according to the intended use of the printed sheet to be obtained, etc. Preferred examples of the reinforcements include coating layers or films made of resins, in particular heat-resistant resins, organic or inorganic fibers, woven or nonwoven fabrics made of such fibers, papers, metal foils, nets, and wires. Suitable ones may be selected from these and other reinforcements. Preferably used are those having excellent weatherability.

Examples of the heat-resistant resins include polyimides, polyetheretherketones, polyethersulfones, polyetherimides, polysulfones, poly(phenylene sulfide), poly(amide-imide)s, polyesterimides, aromatic polyamides, poly(parabanic acid), and epoxy resins. The property of absorbing or scattering ultraviolet rays can be imparted to reinforcements. A reinforcement comprising a metal foil can be advantageously used from the standpoint of ultraviolet ray scattering property, etc.

For forming the ink-receiving layer, suitable fluoropolymers can be used without particular limitations. Examples the fluoropolymers include polytetrafluoroethylene, tetrafluoroethylene/perfluoroalkyl vinyl ether copolymers, tetrafluoroethylene/hexafluoropropylene copolymers, ethylene/tetrafluoroethylene copolymers, poly (chlorotrifluoroethylene) (PCTFE), ethylene/chlorotrifluoroethylene copolymers (ECTFE), poly (vinylidene fluoride) (PVDF), and poly(vinyl fluoride) (PVF).

From the standpoint of suitability for clear printing with a commercial general-purpose thermal transfer printer and from other standpoints, it is preferred to use a fluoropolymer having a melting point of 300° C. or lower, preferably 280° C. or lower, and more preferably 250° C. or lower, such as PVDF, ECTFE, PCTFE, or PVF.

The ink-receiving layer may be formed as a fluoropolymer film which comprises a film, a coating layer, an impregnated film, etc., as described above. In forming the ink-receiving layer, one fluoropolymer or a combination of two or more fluoropolymers may be used. If desired and necessary, a reinforcing substrate of, for example, fibers for obtaining the composite constitution and additives such as a white pigment can be incorporated into the ink-receiving layer.

One or more appropriate polymers other than fluoropolymers can also be used for property improvement or other purposes in forming the ink-receiving layer. The amount of such optional polymers used is up to 80% by weight, preferably up to 50% by weight, and more preferably up to 20% by weight, based on the weight of the fluoropolymer from the standpoint of weatherability retention, etc.

A pigment comprising an inorganic oxide such as titanium oxide, or an ultraviolet absorber comprising, for example, carbon black can also be incorporated into the ink-receiving layer to thereby impart the property of absorbing or scattering ultraviolet rays. The amount of the pigment or ultraviolet absorber incorporated is preferably from 1 to 1,000 parts by weight, more preferably from 5 to 300 parts by weight, and most preferably from 10 to 50 parts by weight, per 100 parts by weight of the fluoropolymer from the standpoints of film strength, ultraviolet resistance, etc. When such a pigment or ultraviolet absorber is incorporated into the reinforcement described above, the property of absorbing or scattering ultraviolet rays can be imparted to the reinforcement.

Thus, by imparting the property of absorbing or scattering ultraviolet rays, ultraviolet rays to the constituent materials other than the ink-receiving layer can be cut off at least 70%.

The thickness of the ink-receiving layer is preferably at least 0.1 $\mu$m from the standpoints of strength, weatherability, etc. Although there is no particular upper limit regarding the thickness of the ink-receiving layer, the thickness of the layer is generally 2 mm or smaller, preferably from 1 $\mu$m to 1.5 mm, and more preferably from 5 $\mu$m to 1 mm, from the standpoint of thickness reduction, etc. The above-described optional measures for, for example, improving the contrast between the ink-receiving layer and the ink information to be imparted may be taken on a reinforcement used in combination with the ink-receiving layer.

The ink information to be imparted to the ink-receiving layer is formed from an ink comprising a fluoropolymer and a colorant as components thereof. By using this ink, ink information having excellent weatherability can be imparted. The ink can be prepared by, for example, mixing one or more fluoropolymers with one or more colorants by an appropriate kneading machine, e.g., a roll mill or three-roll mill, under heating, or mixing the necessary ingredients with each other by an appropriate kneading machine, e.g., a roll mill or pot mill, if desired, using a solvent in which the fluoropolymer(s) dissolve. Thus, the ink can be prepared as a flowable composition, e.g., a pasty composition.

For forming the ink, suitable fluoropolymers such as those enumerated hereinabove with regard to the ink-receiving layer can be used without particular limitations. From the standpoint of suitability for clear printing with a commercial general-purpose thermal transfer printer and from other standpoints, it is preferred to use a fluoropolymer having a melting point of 300° C. or lower, preferably 280° C. or lower, and more preferably 250° C. or lower, such as PVDF, ECTFE, PCTFE, or PVF.

Appropriate colorants for use in conventional inks may be used, such as organic or inorganic pigments, carbon black, and metal powders. Examples of the organic pigments include azo pigments, phthalocyanine pigments, triphenylmethane pigments, metal complex pigments, vat dye pigments, quinacridone pigments, and isoindolinone pigments.

Examples of the inorganic pigments include white pigments such as silica, titania, alumina, zinc white, zirconia, calcium oxide, and mica; red pigments such as manganese oxide/alumina, chromium oxide/tin oxide, iron oxide, and cadmium sulfide/selenium sulfide; blue pigments such as cobalt oxide, zirconia/vanadium oxide, and chromium oxide/divanadium pentoxide; black pigments such as chromium oxide/cobalt oxide/iron oxide/manganese oxide, chromates, and permanganates; yellow pigments such as zirconia/silicon/praseodymium, vanadium/tin, and chromium/titanium/antimony; green pigments such as chromium oxide, cobalt/chromium, and alumina/chromium; and pink pigments such as aluminum/manganese and iron/silicon/zirconium. Preferably used from weatherability and other standpoints are carbon black and pigments based on inorganic oxides.

The proportion of the colorant to the fluoropolymer in the ink is suitably determined according to the contrast between the sheet for printing and the ink, contact bondability in thermal transfer printing, etc. In general, however, the colorant is used in an amount of from 1 to 500 parts by weight, preferably from 10 to 400 parts by weight, and more preferably from 20 to 300 parts by weight, per 100 parts by weight of the fluoropolymer.

Waxes or polymers (e.g., resins) other than the fluoropolymers can be incorporated into the ink for the purpose of lowering the melting point to thereby attain an improvement in thermal transferability, etc. The incorporation amount thereof is preferably up to 80% by weight, more preferably up to 50% by weight, and most preferably up to 20% by weight, based on the weight of the fluoropolymer from the standpoints of weatherability retention, fixability, etc.

An inked sheet such as a printing ribbon is necessary for forming ink information by the thermal transfer printing described above. This inked sheet can be formed by a conventional method such as a method in which the ink is retained in a substrate comprising a film, fabric, etc. by coating, impregnation, or another technique. An appropriate substrate may be used, such as a film of a plastic (e.g., a polyester, polyimide, or fluororesin), or a fabric made of fibers of a polyamide, polyester, etc.

From the standpoint of stability to thermal transfer printing and from other standpoints, it is preferred to use a substrate made of, for example, a heat-resistant plastic having a melting point higher by at least 20° C. than that of the fluoropolymer used as a component of the ink. The thickness of the ink layer in the inked sheet is preferably from 0.2 to 10 μm, more preferably from 0.5 to 5 μm, and most preferably from 0.8 to 4 μm, from the standpoints of obtaining a sufficient density of ink information so as to hide the underlying sheet (ink-receiving layer) and of facilitating the shearing of the ink layer so as to attain satisfactory thermal transferability and impartation of ink information, etc. An effective technique for improving the adhesion of the ink layer is to undercoat the substrate with a wax or the like.

A printed sheet can be formed by imparting information comprising the ink to the ink-receiving layer of the sheet for printing. For this impartation of ink information, an appropriate technique can be used, such as handwriting, printing, or impartation with any of various printers. Ink information can also be imparted by thermal transfer printing with a thermal transfer printer.

The impartation of ink information by thermal transfer printing is preferred in that necessary information can be imparted in situ, etc. according to circumstances to issue identification labels or the like at any time, and that this technique can easily cope with, for example, the management of products in a production system in which many kinds of products are produced in small quantities. Furthermore, according to this thermal transfer printing, the ink during transfer is satisfactorily fused and contact-bonded to the ink-receiving layer to form ink information having excellent weatherability. If desired and necessary, the printed sheet obtained may be heated to thereby improve the fixability and hence weatherability of the ink information.

Any kind of ink information may be imparted to the ink-receiving layer of the sheet for printing. Examples thereof include characters, patterns, and symbols, such as character information, design information, and bar code information, and combinations of these. In the case where a printed sheet such as an identification label is formed, it is preferred to form ink information so as to result in a satisfactory contrast or a satisfactory difference in color tone between the sheet for printing and the ink information.

An adhesive layer can be formed on the sheet for printing or printed sheet of the present invention in order to attach the sheet to an adherend if desired and necessary. Although this adhesive layer may be made of an appropriate adhesive, it is preferably a pressure-sensitive adhesive layer from the standpoint of, for example, facilitating a bonding operation. The adhesive layer can be formed in an appropriate stage before the sheet for printing or the printed sheet is attached to an adherend. Consequently, the adhesive layer may be formed before ink information is imparted to the sheet for printing to obtain a printed sheet, or may be formed after a printed sheet has been obtained.

For forming the pressure-sensitive adhesive layer, an appropriate pressure-sensitive adhesive substance can be used. In general, organic pressure-sensitive adhesives are used. Examples thereof include rubber-based pressure-sensitive adhesives, acrylic pressure-sensitive adhesives, silicone pressure-sensitive adhesives, vinyl alkyl ether pressure-sensitive adhesives, poly(vinyl alcohol) pressure-sensitive adhesives, polyvinylpyrrolidone pressure-sensitive adhesives, polyacrylamide pressure-sensitive adhesives, and cellulosic pressure-sensitive adhesives.

A suitable method may be used for forming the pressure-sensitive adhesive layer on the sheet for printing or on the printed sheet. For example, a method is used, in which a pressure-sensitive adhesive substance is deposited on the sheet for printing or on the printed sheet by an appropriate technique such as a rolling technique using, e.g., calender rolls or a sheet-forming technique using, e.g., a doctor blade or gravure roll coater. A-method is also used, in which a pressure-sensitive adhesive layer is formed on a separator by any of the above techniques and the adhesive layer is transferred to the sheet for printing or the printed sheet.

The thickness of the pressure-sensitive adhesive layer to be formed can be determined according to the intended use of the sheet. In general, the thickness is from 1 to 500 μm. In the case where the pressure-sensitive adhesive layer formed is in an exposed state, the adhesive layer may, if desired, be covered with a separator or the like to thereby prevent the adhesive layer from suffering fouling or the like until the adhesive layer is bonded to an adherend.

The sheet for printing and the printed sheet of the present invention can be advantageously used for various purposes for, e.g., the impartation of identification marks such as bar codes or other kinds of information to various articles such as potteries, glassware, other ceramic products, metallic products, enameled products, resinous products, and wooden products. In particular, since the sheet for printing or the printed sheet has excellent weatherability, it can be preferably used in such applications where articles each bearing the printed sheet are exposed outdoors. These articles may have any shape, e.g., a flat or container shape. In the present invention, the printed sheet may have flexibility so that it can be bonded and fixed to a curved surface, etc.

The present invention will be described below in more detail by reference to the following Examples, but the invention should not be construed as being limited thereto. Unless otherwise indicated, all parts, percents, ratios and the like are by weight.

EXAMPLE 1

A film having a thickness of 25 μm made of a fluoropolymer (PVF, manufactured by E. I. du Pont de Nemours & Co.) (ink-receiving layer) was laminated to one side of a white polyester film having a thickness of 50 μm. On the other side of the white polyester film was formed an acrylic pressure-sensitive adhesive layer having a thickness of 30 μm. Thus, a sheet for printing was obtained. The pressure-sensitive adhesive layer was one obtained from a toluene solution containing 100 parts of poly(butyl acrylate) having a weight-average molecular weight of 300,000 and 2 parts of an isocyanate crosslinking agent by applying the toluene solution with a doctor blade on a separator made of 70 μm-thick glassine paper having a silicone release coating and then drying the applied solution with heating.

On the other hand, 150 parts of a black powder composed of $Cr_2O_3.CoO.Fe_2O_3.MnO_2$ having an average particle diameter of 0.5 μm were added to 100 parts of a fluoropolymer (PVF, manufactured by E. I. du Pont de Nemours & Co.), and this mixture was homogenized with a ball mill at about 250° C. The resulting dispersion was applied on a 6 μm-thick polyester film with a gravure coater for hot melts and then dried to obtain an inked sheet having a 2 μm-thick ink layer.

Subsequently, the inked sheet was used to form a bar code pattern on the ink-receiving layer of the above-described sheet for printing by means of a commercial thermal transfer printer. Thus, a printed sheet was obtained.

EXAMPLE 2

A sheet for printing was obtained in the same manner as in Example 1, except that PVDF was used in place of PVF. An inked sheet having a 3 μm-thick ink layer was obtained by dissolving 100 parts of PVDF and 25 parts of carbon in 70° C. DMF (dimethylformamide), applying the solution on a 6 μm-thick polyester film, and drying the coating. Using these sheets, a printed sheet was obtained in the same manner as in Example 1.

EXAMPLE 3

Thirty parts of rutile titanium oxide was homogeneously mixed with a DMF solution containing 100 parts of PVDF. The resulting mixture was applied on a polyester film and then dried to form a white PVDF film having a thickness of 10 μm (ink-receiving layer). This PVDF film was peeled and recovered from the polyester film.

On the other hand, a PVDF/polymethyl methacrylate coextrusion film (KFC, manufactured by Kureha Chemical Industry Co., Ltd.) was laminated on its polymethyl methacrylate side to a 200 μm-thick white poly(vinyl chloride) film at 150°C. To the PVDF layer was laminated the above-described white PVDF film at 180° C. An acrylic pressure-sensitive adhesive layer having a thickness of 30 μm was then formed on the white poly(vinyl chloride) film of the resulting laminate in the same manner as in Example 1. Thus, a sheet for printing was obtained.

On the other hand, 100 parts of PVDF, 30 parts of carbon, and 30 parts of a ketone resin were dissolved in 70° C. DMF. The resulting solution was applied on a 6 μm-thick polyester film and then dried to obtain an inked sheet having a 2 μm-thick ink layer. Using this sheet and the above-described sheet for printing, a printed sheet was obtained in the same manner as in Example 1.

EXAMPLE 4

A sheet for printing and an inked sheet were obtained in the same manner as in Example 3, except that PCTFE was used in place of PVF. Using these sheets, a printed sheet was obtained in the same manner as in Example 3.

EXAMPLE 5

A printed sheet was obtained in the same manner as in Example 3, except that the laminating of a white PVDF film was omitted and the PVDF layer of the KFC film was utilized as an ink-receiving layer.

Comparative Example 1

A pressure-sensitive adhesive layer was formed on one side of a 50 μm-thick white polyester film (the whole film served as an ink-receiving layer) in the same manner as in Example 3. Thereafter, a bar code pattern was formed on the other side of the polyester film using a commercial inked sheet containing a wax-based ink in the same manner as in Example 1. Thus, a printed sheet was obtained.

Comparative Example 2

The formation of a bar code pattern was attempted in the same manner as in Comparative Example 1, except that the same inked sheet as in Example 3 was used.

Evaluation Tests

Printability

Printability was examined when a printed sheet was formed in each of the above Examples and Comparative Examples.

Weatherability

The separator was peeled from each of the printed sheets obtained in the above Examples and Comparative Examples. Each printed sheet was contact-bonded to a stainless-steel plate through the pressure-sensitive adhesive layer, and then subjected with a sunshine weatherometer to a weathering test corresponding to 10-year outdoor exposure. Thereafter, the surface of each printed sheet was wiped with a cotton cloth to examine the state of the remaining ink pattern and the state of the printed sheet.

The results obtained are shown in the Table below.

| | Printability | Weatherability |
|---|---|---|
| Example 1 | good | no abnormality |
| Example 2 | good | no abnormality |
| Example 3 | good | no abnormality |
| Example 4 | good | no abnormality |
| Example 5 | good | discoloration*1 |
| Comparative Example 1 | good | information disappearance*2 |
| Comparative Example 2 | incapable of printing | |

*1: The sheet for printing discolored.
*2: The ink pattern disappeared.

While the invention has been described in detail and with reference to specific embodiments thereof, it will be apparent to one skilled in the art that various changes and modifications can be made therein without departing from the spirit and scope thereof.

What is claimed is:

1. A sheet for printing, which comprises an ink-receiving layer on a side of the sheet wherein the ink-receiving layer comprises a fluoropolymer film for receiving ink having a melting point of 250° C. or lower, wherein said fluoropolymer film is selected from the group consisting of polyvinyl fluoride and polyvinylidene fluoride, and wherein said ink-receiving layer has the ability to absorb or scatter at least 70% of ultraviolet rays.

2. The sheet for printing of claim 1, wherein the ink-receiving layer has property to absorb or scatter ultraviolet rays.

3. The sheet for printing of claim 1, which further comprises a reinforcement which supports the ink-receiving layer.

4. The sheet for printing of claim 3, wherein the reinforcement has property to absorb or scatter ultraviolet rays.

5. A sheet for printing as claimed in claim 1 further comprising an adhesive layer.

6. A printed sheet comprising an ink-receiving layer comprising a fluoropolymer film, said fluoropolymer film being selected from the group consisting of polyvinyl fluoride and polyvinylidene fluoride, a reinforcement supporting said ink receiving layer and an adhesive layer, and wherein said ink-receiving layer has the ability to absorb or scatter ultraviolet rays; and information comprising ink composed of a fluoropolymer and a colorant formed on the ink-receiving layer of the sheet by thermal transfer printing.

7. An inked sheet for thermal transfer printing, comprising a heat-resistant substrate having formed thereon an ink component comprising 100 parts by weight of a fluoropolymer and 1 to 50 parts by weight of a colorant, said substrate having a melting point at least 20° C. higher than that of the fluoropolymer.

* * * * *